US007261390B2

(12) United States Patent
Nishino

(10) Patent No.: US 7,261,390 B2
(45) Date of Patent: Aug. 28, 2007

(54) INK JET PRINTER

(75) Inventor: Satoshi Nishino, Sayama (JP)

(73) Assignee: Konica Minolta Medical & Graphic, Inc. (JP)

( * ) Notice: Subject to any disclaimer, the term of this patent is extended or adjusted under 35 U.S.C. 154(b) by 307 days.

(21) Appl. No.: 10/977,034

(22) Filed: Oct. 29, 2004

(65) Prior Publication Data

US 2005/0099470 A1 May 12, 2005

(30) Foreign Application Priority Data

Nov. 6, 2003 (JP) ..... 2003-376567

(51) Int. Cl.
*B41J 2/165* (2006.01)

(52) U.S. Cl. ..... 347/22; 347/30; 347/23; 347/29

(58) Field of Classification Search ..... 347/22, 347/85

See application file for complete search history.

(56) References Cited

U.S. PATENT DOCUMENTS 5,896,143 A * 4/1999 Matsui et al. ..... 347/24
6,142,600 A * 11/2000 Takahashi et al. ..... 347/23
6,669,326 B2 * 12/2003 Yazawa et al. ..... 347/23
6,669,335 B2 * 12/2003 Tanaka et al. ..... 347/65
2003/0122905 A1 * 7/2003 Suzuki et al. ..... 347/85
2004/0046828 A1 * 3/2004 Yamada et al. ..... 347/30
2004/0241578 A1 * 12/2004 Hirai ..... 430/270.1

FOREIGN PATENT DOCUMENTS

JP 9-309212 12/1997

OTHER PUBLICATIONS

*English Abstract for JP 09-309212 dated Dec. 2, 1997.

* cited by examiner

*Primary Examiner*—Lamson Nguyen
*Assistant Examiner*—Sarah Al-Hashimi
(74) *Attorney, Agent, or Firm*—Cantor Colburn LLP

(57) ABSTRACT

An ink jet printer has a white ink recording head for jetting white ink onto a recording medium; a color ink recording head for jetting color ink onto the recording medium; a sucking device for providing ink nozzles of the white ink recording head and ink nozzles of the color ink recording head with sucking forces to suck ink in a white ink supply path and in a color ink supply path respectively, the paths communicating with the ink nozzles of the respective recording heads; and a controlling section for controlling sucking forces, wherein, the controlling section controls the sucking forces in such a manner that a sucking force applied to white ink is greater than a sucking force applied to color ink.

9 Claims, 3 Drawing Sheets

INK JET PRINTER

FIELD OF THE INVENTION

The present invention relates to an ink jet printer, and particularly relates to an ink jet printer having a white ink recording head/heads for jetting a white ink and a color ink recording heads for jetting color inks.

BACKGROUND OF THE INVENTION

In recent years, as images can be created simply and inexpensively by gravure printing, ink jet recording has come to be applied to various printing fields including special printing such as photographing, various printing, marking, and color filtering. Especially, in ink jet recording, the followings are combined, by which it is possible to obtain an image comparable to silver halide photography. Namely, it is a combination between recording heads based on an ink jet recording method for jetting and controlling fine particles, inks improved in a color regeneration area, durability, and jettability, and a dedicated paper sheet extremely improved in ink absorbance, coloring material colorability, and surface luster.

On the other hand, however, it is known that pigment contained even in an improved ink as described above gets deposited with time elapsed. It is difficult to obtain an image with a predetermined concentration if pigment is deposited. Therefore ink jet printers capable of diffusing pigment, the pigment having once deposited, again in the ink have been developed.

For example, an ink jet printer disclosed in Patent Document 1 described below includes a recording head for jetting ink onto a recording medium, a carriage that has a recording head and reciprocally moves in the main scanning direction, and an ink tank for storing ink to be supplied to the recording head, the ink tank being mounted on the carriage. The ink tank houses a spherical mover that reciprocally moves in the ink tank accompanying reciprocal movement of the carriage to diffuse deposited pigment.

[Patent Document 1] TOKKAIHEI No. 09-309212

However, although such an ink jet printer can diffuse pigment deposited in an ink tank into ink, it cannot diffuse, into ink, pigment deposited inside a recording head or in an ink supply path such as inside a communicating conduit that communicates the recording head and the ink tank.

Particularly, a pigment with a comparatively large specific gravity, such as titanium oxide contained in white ink, tends to more easily get deposited in an ink supply path due to the specific gravity thereof than a pigment with a small specific gravity for a color ink, and it is difficult to remove the pigment with a comparatively large specific gravity to outside the ink supply path. The pigment deposited in the ink supply path causes ink jetting failure, which causes a problem of lowering image quality.

SUMMARY OF THE INVENTION

With the above background, an object of the invention is to provide an ink jet printer capable of properly removing pigment deposited in an ink supply path to obtain a recorded image with high image quality, which can be attained in the following structure.

An ink jet printer comprises a white ink recording head for jetting white ink onto a recording medium; a color ink recording head for jetting color ink onto the recording medium; a sucking device for providing ink nozzles of the white ink recording head and ink nozzles of the color ink recording head with respective sucking forces to suck ink in a white ink supply path and in a color ink supply path respectively, the paths communicating with the ink nozzles of the respective recording heads; and a controlling section for controlling the sucking forces, wherein, the controlling section controls the sucking forces in such a manner that the sucking force applied to white ink is greater than the sucking force applied to color ink.

The above object of the invention can also be attained with preferable structures as follows.

(1) An ink jet printer comprises a white ink recording head for-jetting white ink onto a recording medium, a color ink recording head for jetting color ink onto the recording medium, a sucking device for applying respective predetermined suction forces to the ink nozzles of the white ink recording head and to the ink nozzles of the color ink recording head, and a control section for controlling the sucking device, wherein the control section sets a sucking force by the sucking device to be applied to the nozzles of the white ink recording head greater than a sucking force to be applied to the nozzles of the color ink recording head.

As described above, a pigment, contained in a white ink, with a specific gravity greater than other pigments is difficult to be removed to outside an ink supply path communicating with nozzles due to the specific gravity thereof. However, according to above item (1), it is possible to properly remove pigment deposited in the ink supply path communicated with the nozzles of the white ink recording head by applying a suction force to the nozzles of the white ink recording head greater than a suction force to be applied to the respective nozzles of the color ink recording heads. Thus, it is possible to prevent clogging of the ink supply path with ink which could otherwise cause ink jetting failure.

(2) In the ink jet printer of item (1), the control section of the ink jet printer drives the sucking device prior to a start of image recording.

According to item (2), prior to the start of image recording, the sucking device properly removes pigment deposited in the ink supply path communicated with the nozzles of the white ink recording head. Thus, at the start of image recording, clogging of the ink supply path with ink can be prevented.

(3) The white ink and the color ink used by the ink jet printer of item (1) or (2) are UV-ray curable inks that are cured by exposure to UV-ray, and the ink jet printer includes a UV-ray emitting device for emitting UV-ray to the ink having landed on the recording medium.

According to item (3), bleeding of recorded image on the recording medium can be prevented by using the UV-ray curable ink even on a recording medium without ink absorbance.

(4) The recording medium used on the ink jet printer of item (3) is a transparent or translucent resin film.

According to item (4), even in a case of using a transparent or translucent resin film without ink absorbance as the recording medium, bleeding of a recorded image on the recording medium can be prevented.

According to above item (1), degradation in image quality caused by ink jetting failure can be prevented, having an effect that a recorded image with high quality can be obtained.

According to item (2), degradation in image quality caused by jetting failure of ink can be prevented at a start of image recording, having an effect that a recorded image with high quality can be obtained.

According to item (3), bleeding of a recorded image on the recording medium can be prevented, having an effect that a recorded image with high quality for which ink bleeding is prevented can be obtained.

According to item (4), even in case of using a transparent or translucent resin film without ink absorbance as the recording medium, bleeding of a recorded image on the recording medium can be prevented, having an effect that a recorded image with high quality for which ink bleeding is prevented can be obtained.

PREFERRED EMBODIMENT OF THE INVENTION

Figure 1:
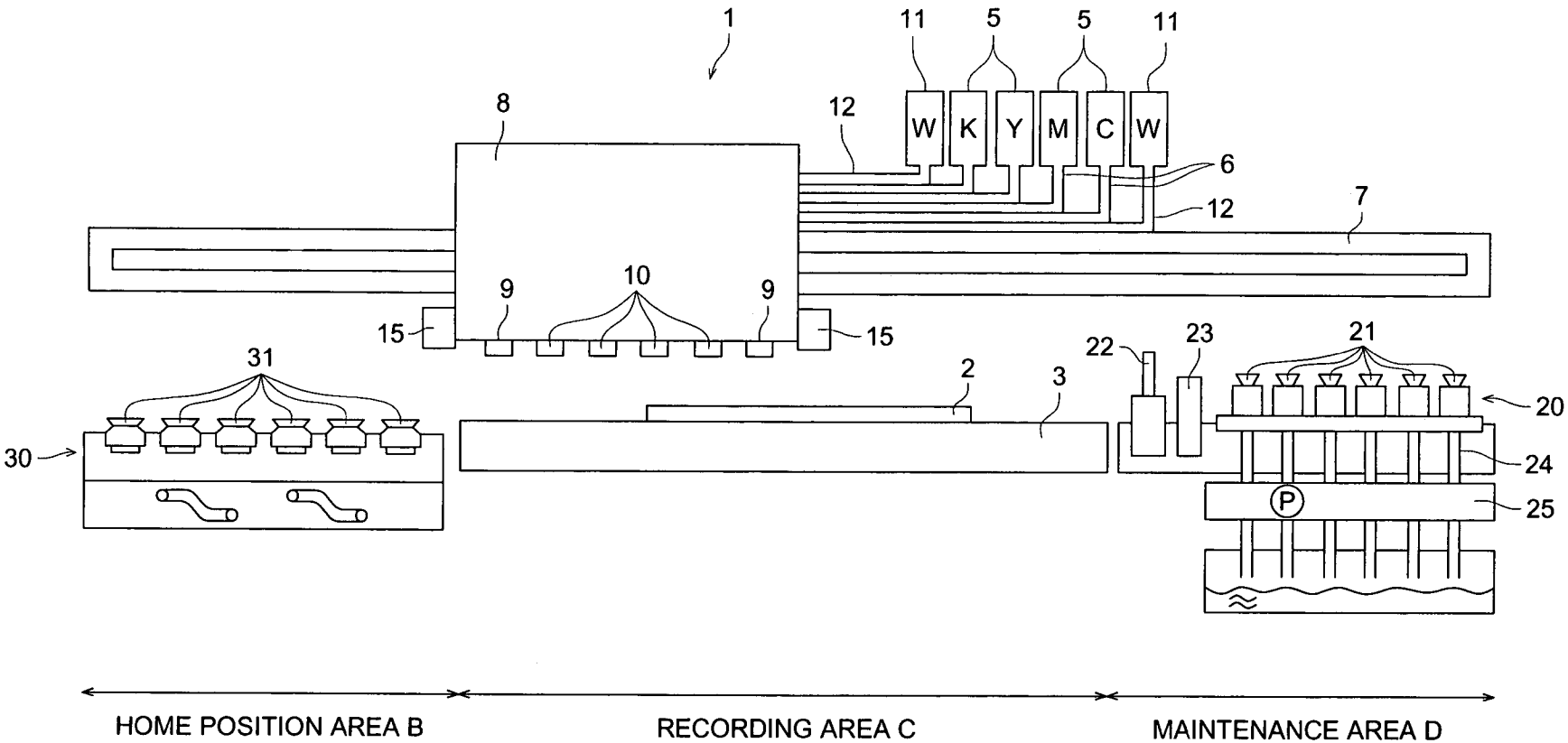
FIG. 1 is a schematic front view showing a structure of an ink jet printer in a first embodiment of the invention.

An embodiment of an ink jet printer according to the invention will be described below referring to the drawings. However, the scope of the invention is not limited to the examples shown in the drawings.

First, an ink jet printer 1 of the invention shown in FIG. 1 is a serial ink jet printer. The ink jet printer 1 is provided with a long-sized housing (not shown) forming the outer frame of the printer, wherein the central part in the longitudinal direction (hereinafter, referred to simply as a main scanning direction) of the housing is arranged as a recording area. One side of the recording area in the main scanning direction is a home position area, and the other side is a maintenance area.

A platen 3 is arranged in the recording area. The platen 3 supports a recording medium 2 on the non-recording surface side, thereby holding the recording surface of the recording medium 2 approximately horizontally. On the both end sides in an orthogonal direction (hereinafter, referred to simply as a sub scanning direction) to the main scanning direction of the platen 3, there is provided a recording medium convey device 4 (see FIG. 2) which conveys the recording medium 2 in the sub scanning direction while supporting the non-recording surface of the recording medium 2. Incidentally, the recording medium 2 is a transparent resin film.

A guide rail 7 is arranged in the housing, extending in the main scanning direction. The guide rail 7 supports and guides a carriage 8 that is driven by a carriage driving device 16 (see FIG. 2) and reciprocally movable in the main scanning direction. On the carriage 8 and in the main scanning direction, there are mounted white ink recording heads 9, 9 for jetting a white ink onto the recording medium 2, and color ink recording heads 10, 10, . . . for jetting color inks, wherein the white ink recording heads 9, 9 are arranged on the both ends of the carriage 8 in the main scanning direction. The carriage 8 moves the white ink recording heads 9, 9 and the color ink recording heads 10, 10, . . . in the main scanning direction from the home position area to the maintenance area. On the side of the white ink recording heads 9, 9 and the color ink recording heads 10, 10, . . . , the side facing the recording medium 2, nozzles (not shown) for jetting ink are disposed in the sub scanning direction.

Color ink tanks 5, 5, . . . respectively storing one of four colors, that is black (K), yellow (Y), magenta (M), and cyan (C), communicate with the color ink recording heads 10, 10, . . . through color ink supply tubes 6, 6, . . . . The color ink recording heads 10, 10, . . . jet inks in a color corresponding to the respective ink tanks 5, 5, . . . . White ink tanks 11, 11 storing a white ink (W) communicate with the white ink recording heads 9, 9 through white ink supply tubes 12, 12. The white ink recording heads 9, 9 jet the white ink. The inner space of the white ink recording heads 9, 9 and the white ink supply tubes 12, 12 communicating with the respective nozzles of the white ink recording heads 9, 9 are ink supply paths for communication between the white ink tanks 11, 11 and the respective nozzles. Likewise, the inner space of the color ink recording heads 10, 10, . . . and the color ink supply tubes 6, 6, . . . communicating with the respective nozzles of the color ink recording heads 10, 10, . . . are ink supply paths for communication between the color ink tanks 5, 5, . . . and the respective nozzles. Incidentally, inside the white ink tanks 11, 11 and the color ink tanks 5, 5, . . . , agitators (not shown) for agitating the stored inks are respectively provided. The agitators agitate the respective inks stored in the white ink tanks 11, 11 and the color ink tanks 5, 5, . . . to make the concentrations of the respective stored inks uniform.

UV-ray emitting devices 15, 15 having a respective UV-ray source (not shown) are mounted on the both ends, in the scanning direction, of the carriage 8 to emit UV-rays to ink having landed on the recording medium 2. Incidentally, a high pressure mercury lamp, a low pressure mercury lamp, a metal halide lamp, a black light, a hot cathode tube, a cold cathode tube, and a LED (Light Emitting Diode) can be employed as the UV-ray source.

In the above maintenance area, there is provided a maintenance unit 20 for maintenance of the white ink recording heads 9, 9 and the color ink recording heads 10, 10, . . . . This maintenance unit 20 includes a plurality of sucking caps 21, 21, . . . for covering the nozzles for jetting the respective inks and the peripheries (hereinafter, simply referred to as a nozzle surface) of the white ink recording heads 9, 9 and the color ink recording heads 10, 10, . . . , to suck the respective inks from the ink supply paths communicating with the respective nozzle surfaces and the nozzles. When the sucking caps 21, 21, . . . cover the respective nozzle surfaces, a sucking device 25 connected to the sucking caps 21, 21, . . . thorough tubes 24 generates negative pressures inside the sucking caps 21, 21, . . . to suck and remove the respective inks from the ink supply paths communicating with the respective nozzle surfaces and the nozzles.

Specifically, in the present embodiment, the sucking caps 21, 21, . . . , the caps covering the nozzle surfaces of the color ink recording heads 10, 10, . . . to suck and remove the color inks, have an inner pressure that is set to −0.05 Mpa by the sucking device 25. On the other hand, the sucking caps 21, 21, . . . , the caps covering the nozzle surfaces of the white ink recording heads 9, 9 to suck and remove the white inks, has an inner pressure that is set to −0.1 Mpa by the sucking device 25. With these pressure values, the respective inks charged in the ink supply paths communicating with the nozzles of the white ink recording heads 9, 9 and the color ink recording heads 10, 10, . . . are sucked and removed. Further, the sucking device 25 may be a cylinder pump or a tube pump.

The maintenance unit 20 includes a cleaning blade 22 for wiping the respective inks adhering to the nozzle surfaces, an ink receiver 23 for receiving respective inks jetted from the white ink recording heads 9,9 and the color ink recording heads 10, 10, . . . for the purpose of cleaning, and an ascending and descending device (not shown) for driving the maintenance unit 20 ascendingly and descendingly.

Next, in the home position area, there is provided a humidifying unit 30 for humidifying the nozzle surfaces of the white ink recording heads 9, 9 and the color ink recording heads 10, 10, . . . . The humidifying unit 30 is provided with six humidifying caps 31, 31, . . . . When the white ink recording heads 9, 9 and the color ink recording heads 10, 10, . . . are in a waiting state, the humidifying caps 31, 31, . . . cover the respective nozzle surfaces to humidify the inks in the respective nozzles.

In the present embodiment, in the vicinity of the nozzle surfaces of the white ink recording heads 9, 9 and the color ink recording heads 10, 10, . . . , a UV-label (not shown) which changes in color, in response to an emitted amount of UV-rays onto the UV-label, is stuck. This UV-label has the property of changing in color from white to red as the emitted amount of UV-rays increases. At a position between the home position area and the maintenance area, there is arranged a detecting device 45 (see FIG. 2) capable of detecting the color of the UV-label. The detecting device 45 has a reflection sensor (not shown) for measuring the reflectance of a light and has a red LED (not shown), wherein a red light emitted from the red LED is reflected by the UV-label, and the reflection sensor receives the reflected light to measure the reflectance.

Figure 2:
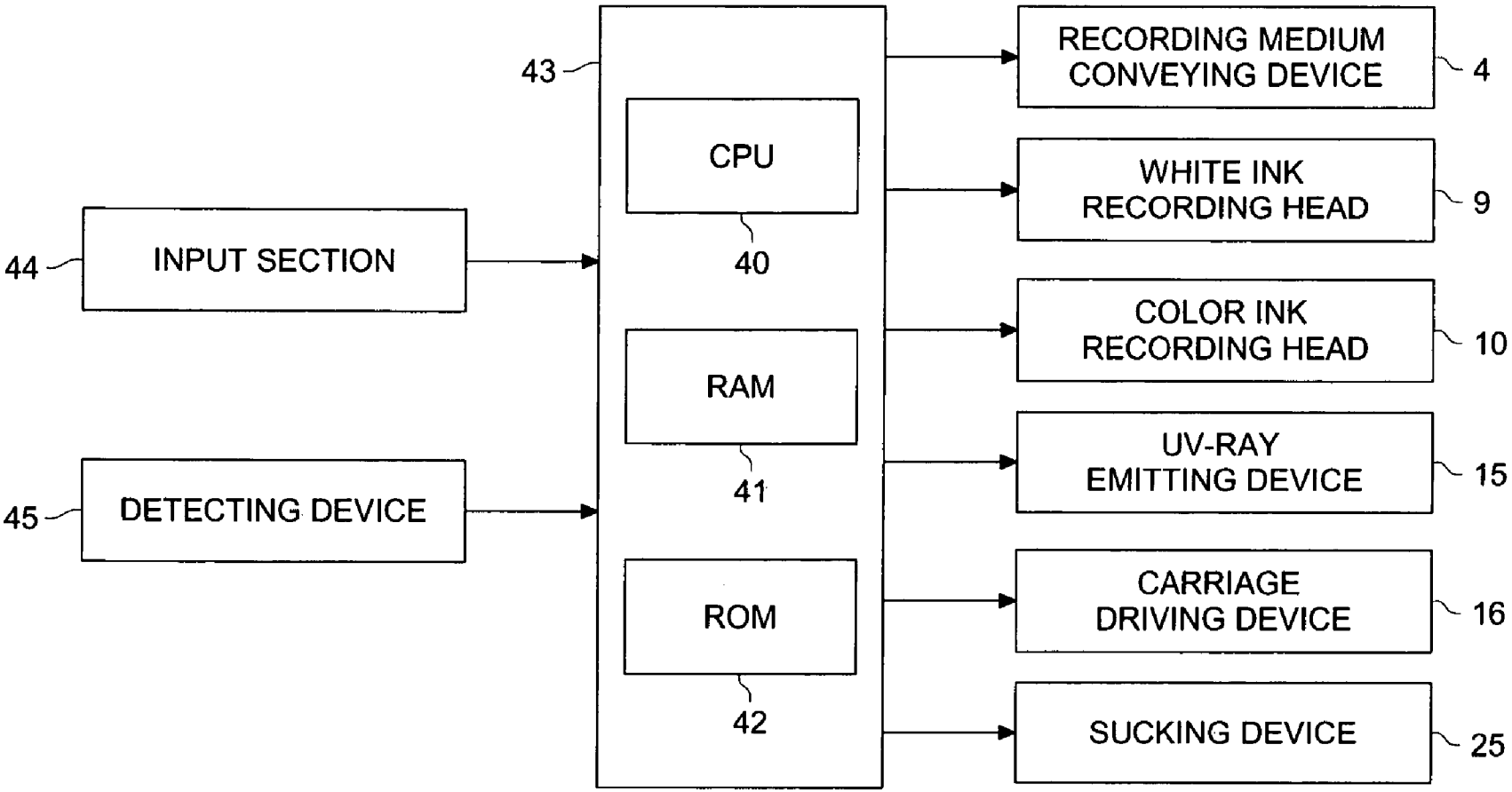
FIG. 2 is a block diagram showing a configuration of the above ink jet printer.

Next, a controlling device of the present embodiment will be described referring to FIG. 2.

This controlling device is configured of a CPU 40, a RAM 41, and a ROM 42, for example, wherein the control device includes a controlling section 43 for extending a processing program recorded in the ROM 42 into the RAM 41 to execute the processing program by the CPU 40.

The controlling section 43 is connected with an input section 44 configured with a scanner for input of image information, a keyboard for input of image recording conditions, and the like, wherein, based on predetermined information input from the input section 44 and based on the above processing program, the controlling section 43 controls the operations of the recording medium conveying device 4, the white ink recording heads 9,9, the color ink recording heads 10, 10, . . . , the UV-ray emitting device 15, the carriage driving device 16, the sucking device 25, etc.

The controlling section 43 is connected with the detecting device 45 and determines the degree of change in the color of the UV-label, based on detected information input from the detecting device 45. When the controlling section 43 determines that the color of the UV-label has changed to a predetermined degree of change in color, the controlling section 43 controls the carriage driving device 16 and the maintenance unit 20 to automatically perform maintenance operation.

Prior to a start of image recording, upon input of predetermined information from the input section 44, the controlling section 43 controls the carriage driving device 16 and the maintenance unit 20 to automatically perform the maintenance operation on the white ink recording heads 9, 9.

Next, "ink" used in the present embodiment will be described.

An ink used in the present embodiment is a UV-ray curable ink that is cured by exposure to UV-ray and has at least a polymerization compound (including known polymerization compounds), a photoinitiator, and a coloring material, as main components.

As a polymerization compound, the UV-ray curable ink can be roughly categorized into UV-ray curable inks of radical polymerization containing a radical polymerization compound and UV-curable inks of cation polymerization containing a cation polymerization compound. Inks of the both categories can be applied as an ink used in the present embodiment, and a hybrid type ink of a combination of a UV-ray curable ink of radical polymerization and a UV-ray curable ink of cation polymerization may be applied as an ink to be used in the present embodiment. Compared with a UV-ray curable ink of radical polymerization, a UV-ray curable ink of cation polymerization has a higher sensitivity to UV-rays and polymerization reaction of the UV-ray curable ink of cation polymerization is less inhibited by oxygen, reducing the exposure intensity required for curing the ink. Thus, a UV-ray curable ink of cation-polymerization is employed as the ink in the present embodiment.

A white pigment of a white ink used for this embodiment may be a pigment to make an ink composite white, usually, a white pigment used for this field can be used. As such a white pigment, for example, an inorganic white pigment, an organic white pigment, and white hollow polymer fine particles can be used.

As the inorganic white pigment, sulfate of alkaline earth metals such as barium sulfate, carbonate of alkaline earth metals such as calcium carbonate, fines silicic acid, silica such as synthetic silicate, calcium silicate, alumina, alumina hydrate, titanium oxide, zinc oxide, talc, clay, etc. may be listed. Especially the titanium oxide is known as a desirable white pigment in terms of concealment nature and coloring nature, and dispersion particle size.

As an organic white pigment, an organic compound salt shown in the official gazette of TOKKAIHEI No. 11-129613 and alkylenebismelamine derivative shown in the official gazette of TOKKAIHEI No. 11-140365 and the official gazette of TOKKAI No. 2001-234093 may be listed.

As white hollow polymer fine particles, fine particles, having thermal plasticity, made of substantially an organic polymer disclosed in U.S. Pat. No. 4,089,800 may be employed. White pigment may be used alone or in combination.

Dispersion of a white pigment is preferably 0.1 to 1.0 μm in the average particle diameter, and is 0.3 to 10 μm and preferably 0.3 to 3 μm in the maximum particle diameter. In such a manner, a pigment, a dispersion agent, selection of a dispersion medium, dispersion conditions, and filtering conditions are set. By such arrangement of particle diameters, ink preserving stability, concealment nature, and curing sensitivity, can be maintained.

A white pigment is contained in 1 to 50 weight percent of the total ink, and preferably 2 to 30 weight percent. If the contained amount of the white pigment is less than this, concealment due to whit ink cannot be attained, and if greater, the curability of a white ink layer may be degraded, or a cured film may be brittle.

In the present embodiment, a white ink containing titanium oxide of a specific gravity of 4.20 g/cm$^3$ as a main pigment is employed. Titanium oxide has a larger specific gravity than those of pigments contained in inks of colors of black (K), yellow (Y), magenta (M), and cyan (C), and therefore, titanium oxide gets deposited in the ink in a short time.

A cation polymerization UV-ray curable ink has a property of accumulating UV-ray energy and tends to increase the viscosity thereof by exposure to UV-rays. Therefore, by monitoring the degree of change in the color of a UV-label having the property of accumulating once taken UV-ray energy without discharging it, the accumulation degree of UV-rays in the cation polymerization UV-ray curable ink can be accurately determined.

As the recording medium 2 employed in the present embodiment, a non-absorbent resin film, transparent or nontransparent, for flexible packaging can be applied. Applicable resins for the resin film include polyethylene terephthalate, polyester, polyolefine, polyamide, polyester amide, polyether, polyimide, polyamidoimide, polystyrene, polycarbonate, poly-gamma-phenylene sulfide, polyether ester, polyvinylchloride, poly (meth)acrylate ester, polyethylene, polypropylen, nylon, and the like, and further, copolymers, mixtures, and arches of them as well. For a resin of the resin film, it is particularly preferable to select one among stretched polyethylene terephthalate, polystyrene, polypropylen, and nylon, for transparency, dimensional stability, rigidity, environmental charge, and cost of the resin film, wherein further preferably a resin film with a thickness in the range from 2 to 1000 μm (more preferably 20 to 150 μm) is used. Still further, surface treatments such as corona discharge treatment or easy adherence treatment may be performed on the surface of a support of the resin film.

Next, the operation of the ink jet printer 1 in accordance with the present embodiment will be described.

When a user sets the recording medium 2 on the ink jet printer 1 and turns on the power supply, the UV-ray source emits UV-rays.

When predetermined information is input from the input section 44 to the controlling section 43, the controlling section 43 controls the recording medium conveying device 4 to convey the recording medium 2 in the sub scanning direction, having the UV-ray source burning. The recording medium conveying device 4 repeats conveying and stop of conveying, thereby intermittedly conveying the recording medium 2.

During a stop in the intermitted conveyance, the controlling section 43 controls the white ink recording heads 9, 9, the color ink recording heads 10, 10, . . . , and the carriage driving device 16 to jet inks to respective specific positions on the recording medium 2. In this situation, the UV-ray emitting devices 15, 15 move integrally with the carriage 8, accompanying the movement of the carriage 8, and thus the inks having landed on the recording medium 2 are cured by UV-rays emitted by the UV-ray emitting sources. In such a manner, an image is recorded on the recording medium 2. Employing UV-curable inks as described above, even on the recording medium 2 without ink-absorbance used in the present embodiment, the recorded image can be prevented from bleeding on the recording medium 2.

Upon input of the predetermined information from the input section 44, or upon determination that the color of the UV-label has changed to the predetermined degree of change in color, the controlling section 43 in accordance with the present embodiment moves the carriage 8 to a position where the sucking caps 21, 21, . . . of the maintenance unit 20 and the recording heads, which are the white ink recording heads 9,9 and the color ink recording heads 10, 10, . . . , face each other.

When the carriage 8 has moved to the above position, the controlling section 43 controls the maintenance unit 20 to make the sucking caps 21, 21, . . . and the respective nozzle surfaces of the white ink recording heads 9, 9 and the color ink recording heads 10, 10, in tight contact with each other. In this state, the controlling section 43 operates the sucking device 25 to generate negative pressures inside the respective sucking caps 21, 21, . . . . These negative pressures create sucking forces on the respective nozzle surfaces and at the nozzles so as to suck and remove ink and the like from the respective ink supply paths communicating with the respective nozzle surfaces and the nozzles.

Titanium oxide, which is the main pigment of the white ink, is difficult, due to the specific gravity, to be removed outside the ink supply paths communicating with the nozzles of the white ink recording heads 9, 9. Therefore, in the present embodiment, a greater sucking force is given to the nozzles of the white ink recording heads 9, 9 than a sucking force given to the nozzles of the color ink recording heads 10, 10, . . . . Thus, titanium oxide deposited in the ink supply paths communicating with the nozzles of the white ink recording heads 9, 9 can be properly removed. In such a manner, the ink supply paths of the white ink recording heads 9, 9 are prevented from clogging with ink.

Further, white ink with nonuniform concentration in the ink supply paths can be sucked and removed with the above described sucking force. Incidentally, in the present embodiment, the concentration of each ink stored in the white ink tanks 11, 11 and the color ink tanks 5, 5, . . . is made uniform by an agitator. Accordingly, the ink jet printer 1 in accordance with the present embodiment can make the ink concentration of respective newly fed inks uniform at a start of image recording, the newly fed inks being fed accompanying the above sucking removal of older inks in respective ink supply paths.

Still further, at start of image recording, more specifically, when predetermined information is input from the input section 44, white ink with nonuniform ink concentration in the ink supply paths can be sucked and removed with the above described sucking force. Therefore, in the ink jet printer 1 of the present embodiment, ink concentration in the ink supply paths at the start of image recording can be made uniform.

As described above, with the ink jet printer 1 of the present embodiment, by the use of UV-curable inks, even in a case of employing a non-ink-absorbent resin film, transparent or translucent, as the recording medium 2, the recorded image is prevented from bleeding on the recording medium 2, which has an effect to obtain a recorded image with high quality free from ink bleeding.

Further, it is possible to prevent ink clogging of the ink supply paths of the white ink recording heads 9, 9 and make the ink concentration in the ink supply paths uniform, having an effect to obtain a recorded image with high quality, wherein ink jetting failure due to ink clogging and nonuniformity in ink concentration are prevented.

Still further, it is possible to make the ink concentration in the ink supply paths of the white ink recording heads 9, 9 uniform at a start of image recording, having an effect to obtain a recorded image with high quality, wherein nonuniformity in ink concentration is prevented from the start of image recording.

In the present embodiment, when the controlling section 43 receives input of the predetermined information from the input section 44, maintenance is performed. However, the present embodiment is not limited to this. For example, the ink jet printer 1 may be provided with a timer for measuring an idling time of the white ink recording heads 9,9 and perform the above maintenance when a predetermined elapse time is detected. Or, just after the power supply of the ink jet printer 1 turns on, the above maintenance may be performed.

Yet further, with the ink jet recoding apparatus 1 in accordance with the present embodiment, both front printing and back printing are possible. The front printing is, for example, a printing method for performing image recording on a transparent recording medium 2, wherein an ink in a color to be applied for a background is jetted on the entire surface of the recording medium 2, and then another ink is jetted to form an image, superimposing at a part where the ink in the color of the background has been dried or cured.

This printing method makes it difficult for light to pass through a part where the image is formed, and thereby the image can stand out. On the other hand, the back printing is a printing method for performing image recording on a transparent recording medium 2, wherein an ink for forming an image is jetted onto a predetermined area of the recording medium 2, and then another ink in a color to be applied for a background is jetted, superimposing at a part where the ink in the color of the background has been dried or cured. In this printing method, an image is formed on a back surface side of the transparent recording medium 2, inks being jetted on the back surface side. Therefore, in addition to having an effect to make the image stand out, the back printing method can maintain durability against rubbing of the image. The recording medium may be transparent or translucent, that is, a recording medium through which an image on the back surface side is seen can be employed.

Since the ink jet printer 1 of the present embodiment employs a white ink for a background, the ink jet printer 1 has an effect to efficiently make images formed by color inks stand out to a higher degree than images with a background in a color other than white.

Figure 3:
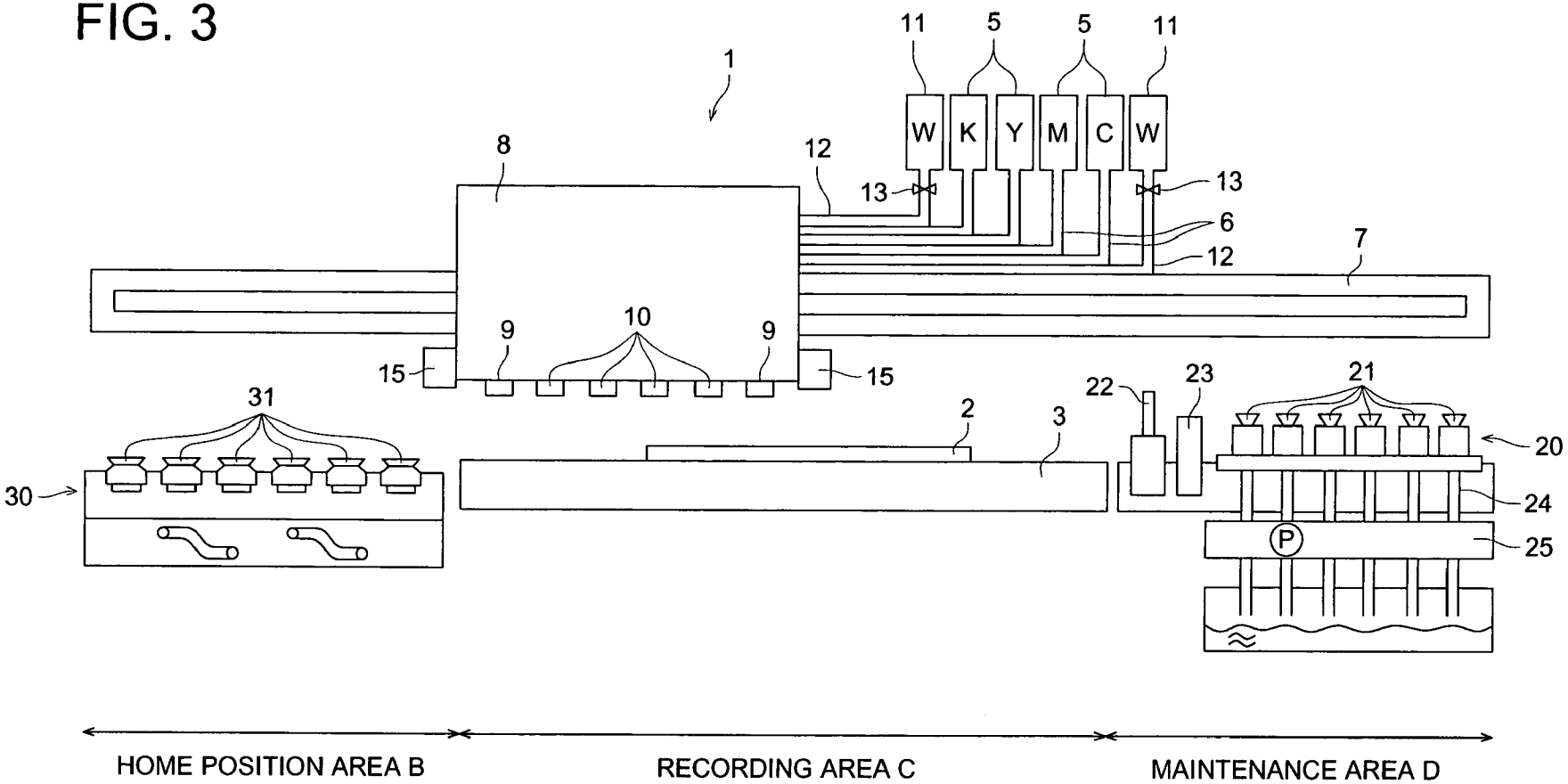
FIG. 3 is a schematic front view showing a structure of an ink jet printer in a second embodiment of the invention.

Next, an ink jet printer 1A in accordance with a second embodiment will be described referring to FIG. 3. Elements in the present embodiment common with those of the ink jet printer 1 of the first embodiment are given the same reference symbols.

In the above first embodiment, as an example, the ink jet printer 1 has been described, wherein the controlling section 43 controls the sucking forces such that the sucking force applied at the nozzles of the white ink recording heads 9, 9 by the sucking device 25 is greater than the sucking force applied at the nozzles of the color ink recording head 10, 10, . . . by the sucking device 25, and thus the white ink and the deposited white pigment in the white ink supply paths are sucked and removed. In the ink jet printer 1A of the present embodiment, a controlling section 43 closes on-off valves 13, 13, each valve being provided at an ink inlet of a respective white ink supply path, at a start of sucking by a sucking device 25 in order to generate pressure difference between the pressure on the side of ink supply tanks 11, 11 and the pressure on the sucking side extending from the on-off valves 13, 13 to the nozzles of the white ink recording heads 9, 9 through the white ink supply paths. Then, the controlling section 43 opens the on-off valves 13, 13 to cause high flow velocity of white ink, thereby making the sucking force applied to the white ink great.

Thus, the second embodiment also has effects similar to those of the first embodiment.

Of course, the invention is not limited to the first and second embodiments and can be modified properly as necessary.

For example, in the second embodiment, the closed valve is opened to cause high flow velocity of white ink, thereby making the sucking force of the white ink great. In addition to this, as a modification of the second embodiment, it is also possible to make the sucking force applied at the nozzles of the white ink recording heads greater than the sucking force applied at the nozzles of the color ink recording heads likewise in the first embodiment, thereby making the sucking force applied to the white ink even greater.

Or, the diameter of the supply paths of the white ink can be made smaller to an extent which causes no failure in white ink flow so that a negative pressure generated for the white ink is made greater than a negative pressure generated for the color inks.

What is claimed is:

1. An ink jet printer comprising:

a white ink recording head for jetting white ink onto a recording medium;

a color ink recording head for jetting color ink onto the recording medium;

a sucking device for providing ink nozzles of the white ink recording head and ink nozzles of the color ink recording head with sucking forces to suck ink in a white ink supply path and in a color ink supply path respectively, the paths communicating with the ink nozzles of the respective recording heads; and a controlling section for controlling sucking forces, wherein a pigment contained in the white ink has a specific gravity greater than a pigment contained in the color ink; and wherein the controlling section controls the sucking forces in such a manner that a sucking force applied to white ink is greater than a sucking force applied to color ink.

2. The ink jet printer of claim 1, wherein the controlling section controls the sucking forces in such a manner that a sucking force provided at the nozzles of the white ink recording head by the sucking device is greater than a sucking force provided at the nozzles of the color ink recording head by the sucking device, and thereby the sucking force applied to white ink is greater than the sucking force applied to color ink.

3. The ink jet printer of claim 1, further comprising an on-off valve at an ink inlet of the white ink supply path, wherein, the controlling section closes the on-off valve prior to a start of sucking by the sucking device;

opens the on-off valve during the sucking so that a sudden pressure change caused by opening the valve causes high velocity of the white ink inside the white ink supply path, the valve having divided a space into a space with a normal pressure and a space with an accumulated negative pressure generated by the sucking device prior to being opened; and thus controls the sucking forces such that the sucking force applied to white ink is greater than the sucking force applied to color ink.

4. The ink jet printer of claim 1, further comprising an on-off valve at an ink inlet of the ink supply path of the white ink, wherein, the controlling section makes a sucking force provided at the nozzles of the white ink recording head by the sucking device is greater than a sucking force provided at the nozzles of the color ink recording head by the sucking device;

further, closes the on-off valve prior to a start of sucking by the sucking device, opens the on-off valve during the sucking so that a sudden pressure change caused by opening the valve causes high velocity of the white ink inside the white ink supply path, the valve having divided a space into a space with normal pressure and a space with an accumulated negative pressure generated by the sucking device prior to being opened; and thus controls the sucking forces such that the sucking force applied to white ink is greater than the sucking force applied to color ink.

5. The ink jet printer of claim 1, wherein the controlling section drives the sucking device upon input of predetermined information from an input section, prior to a start of image recording.

6. The ink jet printer of claim 1, wherein, the controlling section drives the sucking device when the controlling section determines that a color of a UV-label of which color changes in response to a UV-ray exposure amount has changed to a predetermined degree of change in color.

7. The ink jet printer of claim 1, further comprising a UV-ray emitting device for emitting UV-ray to ink having landed on the recording medium, wherein, the white ink and the color ink are photocurable inks which are cured by exposure to UV-ray.

8. The ink jet printer of claim 7, wherein the recording medium is a transparent or translucent resin film.

9. The ink jet printer of claim 2, wherein the controlling section controls the sucking forces such that an attained maximum negative pressure applied inside the white ink supply path is equal to or greater than 0.5 atm, and an attained negative pressure applied inside the color ink path is smaller than 0.5 atm is.

* * * * *